US011541254B2

(12) United States Patent
Esposito

(10) Patent No.: US 11,541,254 B2
(45) Date of Patent: Jan. 3, 2023

(54) EMERGENCY SLIDE SYSTEM

(71) Applicant: Charles Esposito, Hasbrouck Heights, NJ (US)

(72) Inventor: Charles Esposito, Hasbrouck Heights, NJ (US)

( * ) Notice: Subject to any disclaimer, the term of this patent is extended or adjusted under 35 U.S.C. 154(b) by 325 days.

(21) Appl. No.: 16/853,179

(22) Filed: Apr. 20, 2020

(65) Prior Publication Data

US 2021/0322794 A1 Oct. 21, 2021

(51) Int. Cl.

| | |
|---|---|
| ***A62B 1/20*** | (2006.01) |
| ***E04F 11/00*** | (2006.01) |
| *E04F 11/18* | (2006.01) |

(52) U.S. Cl.

CPC ..... *A62B 1/20* (2013.01); *E04F 2011/005* (2013.01); *E04F 2011/1876* (2013.01)

(58) Field of Classification Search

CPC ..... A62B 1/20; E04F 2011/1876

See application file for complete search history.

(56) References Cited

U.S. PATENT DOCUMENTS 3,063,513 A * 11/1962 Marryatt ..... B63B 27/14 182/21
3,980,155 A * 9/1976 Campbell ..... A62B 1/20 182/49
4,498,557 A * 2/1985 Horne ..... A62B 1/20 193/12
4,606,431 A * 8/1986 Ruder, Sr. ..... A62B 1/20 52/182
4,773,505 A * 9/1988 Chiba ..... E04F 11/00 182/49
4,943,048 A * 7/1990 Hentges ..... A63G 21/00 182/49
5,020,633 A * 6/1991 Rangel ..... E06C 9/14 182/100
5,209,323 A * 5/1993 Hopkins ..... A62B 1/20 182/48
5,427,574 A * 6/1995 Donnelly-Weide .... A63G 21/00 472/117
5,535,848 A * 7/1996 Giuliano ..... A62B 1/20 182/113
6,763,911 B2 * 7/2004 Burch ..... A62B 1/20 182/49

(Continued)

*Primary Examiner* — Brian D Mattei
*Assistant Examiner* — Kathleen M. McFarland
(74) *Attorney, Agent, or Firm* — Daniel M. Cohn; Howard M. Cohn

(57) ABSTRACT

An emergency slide system to provide an evacuation of a high-rise building comprises a plurality of slide assemblies configured for movement from a first stowed position to a second deployed position. Each of the plurality of slide assemblies are built into a wall adjacent each of the flights of stairs disposed in the stairwell of the building. Each of the plurality of slide assemblies is disposed in a storage enclosure built into the wall adjacent each of the flights of stairs disposed generally parallel to the flights of stairs designed to zig zag down from an upper floor of the building to a lower floor. Each of the slide assemblies is constructed of an elongated escape chute to enable a person exiting the building to slide down a plurality of the elongated escape chutes between the upper and lower floors disposed in the stairwell of the high-rise building.

8 Claims, 4 Drawing Sheets

(56) References Cited

U.S. PATENT DOCUMENTS

| | | | | |
|---|---|---|---|---|
| 7,191,869 | B1 * | 3/2007 | Denison | A62B 1/20 182/49 |
| 9,802,065 | B2 * | 10/2017 | Zhou | A63G 21/00 |
| 2003/0234139 | A1 * | 12/2003 | Burch | A62B 3/00 182/49 |
| 2005/0121257 | A1 * | 6/2005 | Desrosiers | A62B 1/20 182/48 |
| 2008/0142297 | A1 * | 6/2008 | Desrosiers | A62B 1/20 182/48 |
| 2014/0196383 | A1 * | 7/2014 | Jie | E04B 1/94 182/138 |
| 2020/0172254 | A1 * | 6/2020 | LeBlanc-Dear | B64D 25/14 |
| 2021/0322794 | A1 * | 10/2021 | Esposito | A62B 1/20 |

* cited by examiner

EMERGENCY SLIDE SYSTEM

TECHNICAL FIELD OF THE INVENTION

The present invention relates generally to an emergency slide system. More specifically, the present invention relates to an emergency slide system that is designed to deploy to aid in the expedient escape from a building.

BACKGROUND OF THE INVENTION

Fires and other emergency situations require immediate action to safely evacuate the structure and minimize injury to individuals trying to escape from the structure. The problems with respect to such disasters have been more serious in multi-story structures as evacuation is much more difficult than that of a single story structure. Most multi-story homes have only a single stair case exit from the up stairs and those multi-story structures that have elevators are unable to use them in times of disasters.

Individuals routinely work and live at elevations that do not permit safe free-fall drops in emergency situations. Ladders are often unavailable or inadequate in height. Jumping from a window or from a roof is many times the only tenable option. In practical terms, any fall in excess of five meters creates a grave probability of injury or death. Alternative evacuation plans for individuals, such as helicopter evacuations from roof tops, are time consuming, dangerous and often impossible due to fire, explosions, surrounding structures and weather.

Emergencies, such as fires, often limit escape options. The chaos and mass confusion that accompany emergencies increase evacuation times and delay rescues. Descending stairs in fire exits becomes a dangerous experience, as excessive numbers of excited people crowd into the exits, pushing and tripping one another in attempting to reach safety. Heat and toxic gases further complicate evacuations. Needs exist for evacuation systems that provide quick and easy escape routes.

Recent emergencies across the United States have demonstrated the need for quicker evacuation systems. During the bombing of the World Trade Center in New York, it took rescue workers over five hours to evacuate the buildings. While there was smoke and no power, other emergency conditions were ideal. There was no fire and no continuing threat. The buildings had strong structural integrity. Highly trained and well-equipped emergency services and personnel were readily available. Under non-ideal circumstances with fire, smoke and a continuing threat, a five-hour evacuation would have inevitably resulted in a massive loss of life.

SUMMARY OF THE INVENTION

According to another embodiment of the present invention, there is disclosed an emergency slide system to provide an evacuation of a high-rise building. The emergency slide system comprises a plurality of slide assemblies configured for movement from a first stowed position to a second deployed position. Each of the plurality of slide assemblies are built into a wall adjacent each of the flights of stairs disposed in the stairwell of the high-rise building. Each of the plurality of slide assemblies is disposed in a storage enclosure built into the wall adjacent each of the flights of stairs disposed generally parallel to the flights of stairs designed to zig zag down from an upper floor of the building to a lower floor. Each of the plurality of slide assemblies is constructed of an elongated escape chute to enable a person exiting the building to slide down a plurality of the elongated escape chutes between the upper and lower floors disposed in the stairwell of the high-rise building.

According to another embodiment of the present invention, there is disclosed an emergency slide system to provide an evacuation of a high-rise building. The slide system comprises a plurality of slide assemblies configured for movement from a first stowed position to a second deployed position. Each of the plurality of slide assemblies is built into a wall adjacent flights of stairs disposed in the stairwell of the high-rise building. Each of the plurality of slide assemblies is housed in one of a plurality of storage enclosures built in the wall adjacent each of the plurality of slide assemblies. Each of the storage enclosures is built into the wall adjacent each of the flights of stairs and disposed generally parallel to the flights of stairs so as to zig zag down from an upper floor of the building to a lower floor. Each of the plurality of slide assemblies is constructed of an elongated escape chute adapted to pull out from a first stored position in one of the plurality of storage enclosures mounted in the wall to a second, extended position where the chute projects out from the storage enclosure so as to extend over the stairs.

According to another embodiment of the present invention, there is disclosed an emergency slide system to provide an evacuation of a high-rise building, comprising two cylindrical escape tubes located in a stairwell within the high-rise building and built adjacent flights of stairs within the stairwell. The two cylindrical escape tubes are disposed generally adjacent to the flights of stairs so as to zig zag down from one floor of the building to a lower floor of the building.

According to another embodiment of the present invention, there is disclosed an emergency slide system to provide an evacuation of a high-rise building, comprising two cylindrical half escape tubes located in a stairwell within the high-rise building and built adjacent flights of stairs within the stairwell. The two cylindrical half escape tubes disposed generally adjacent to the flights of stairs so as to zig zag down from one floor of the building to a lower floor of the building.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

Figure 1:
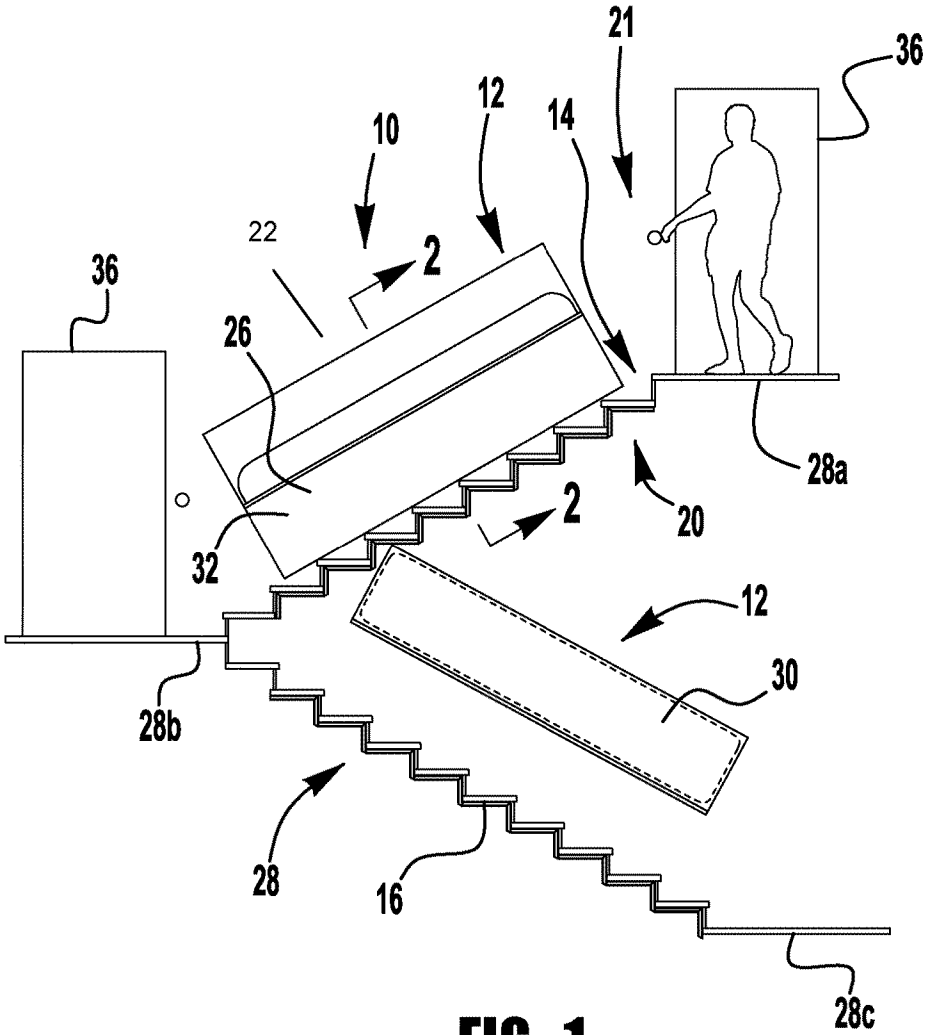

These and other objects of the present invention will become apparent, particularly when taken in light of the following illustrations wherein:

FIG. 1 is a side view of a first embodiment of the emergency slide system in a stairwell, in accordance with the present invention.

Figure 2:
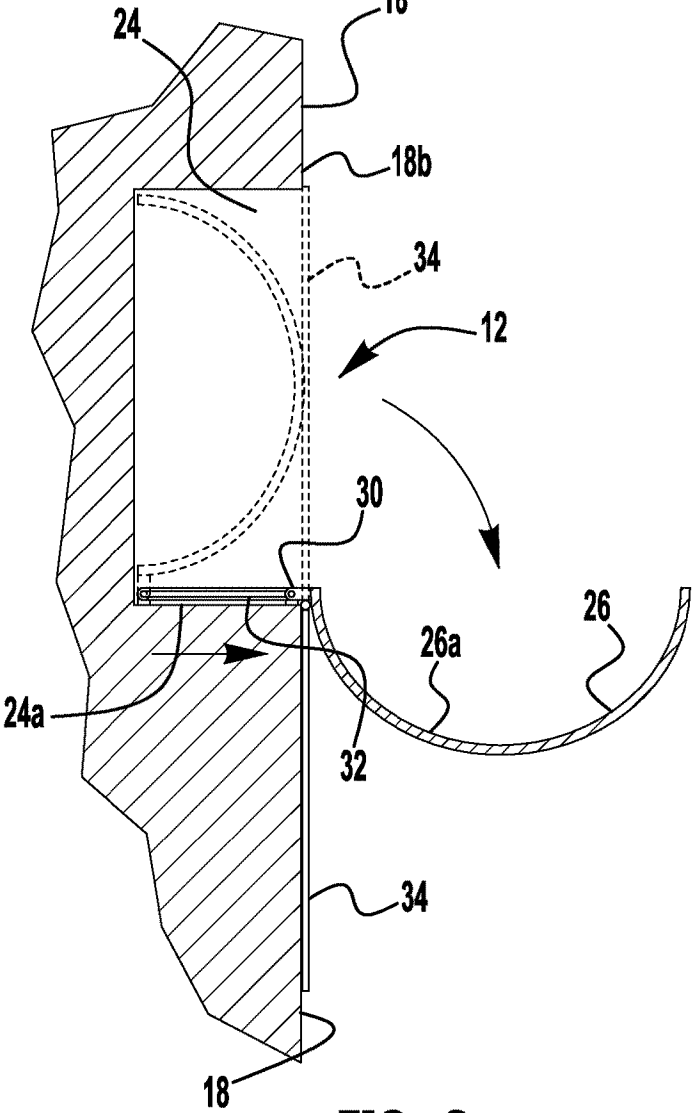

FIG. 2 is a cross-sectional view through line 2-2 of FIG. 1, showing the emergency slide system in an open configuration, in accordance with the present invention.

Figure 2A:
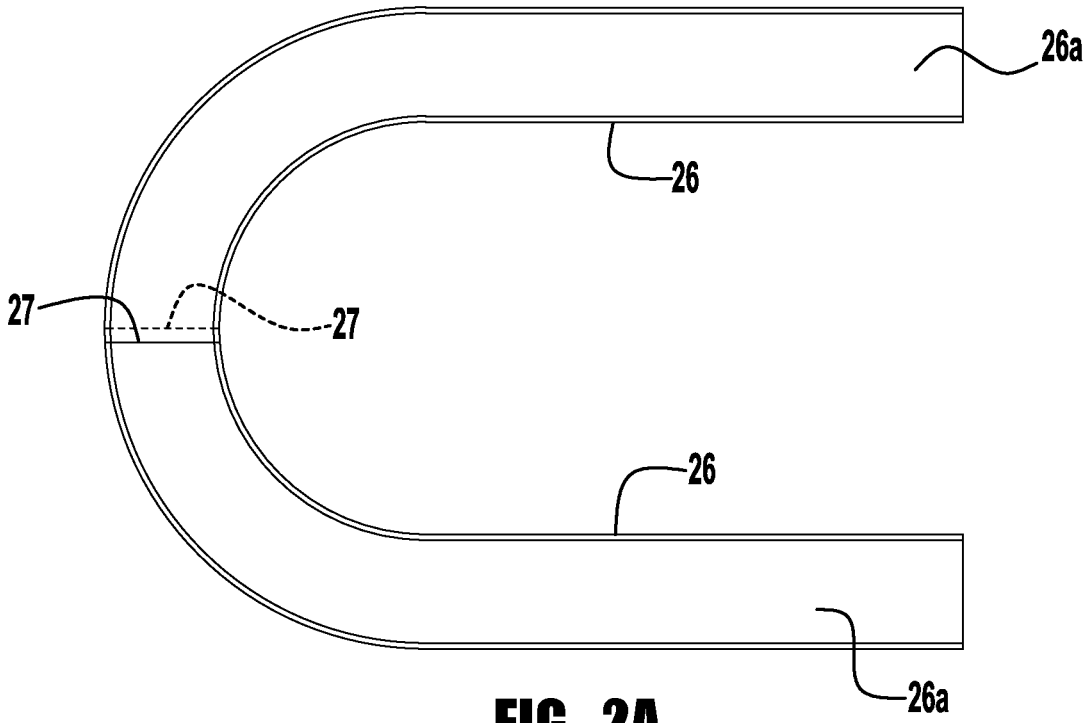

FIG. 2A is a top view showing the emergency slide system of FIG. 1 in an open configuration, in accordance with the present invention.

Figure 3:
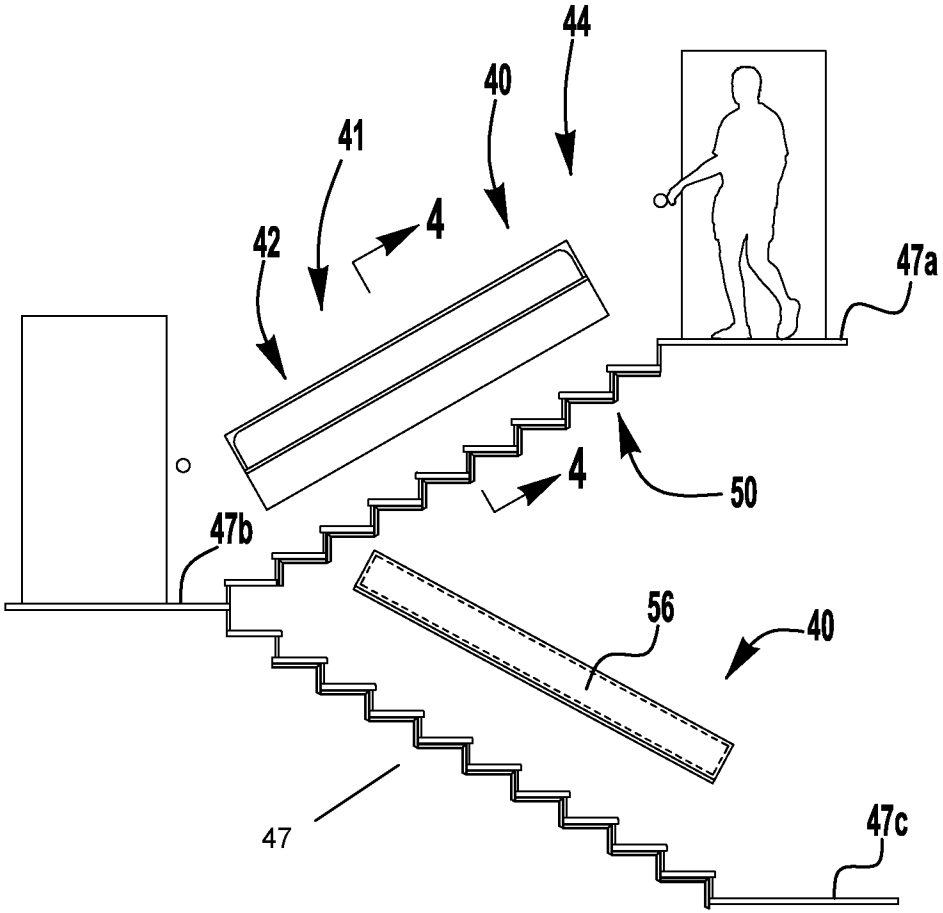

FIG. 3 is a side view of a second embodiment of the emergency slide system in a stairwell, in accordance with the present invention.

Figure 4A:
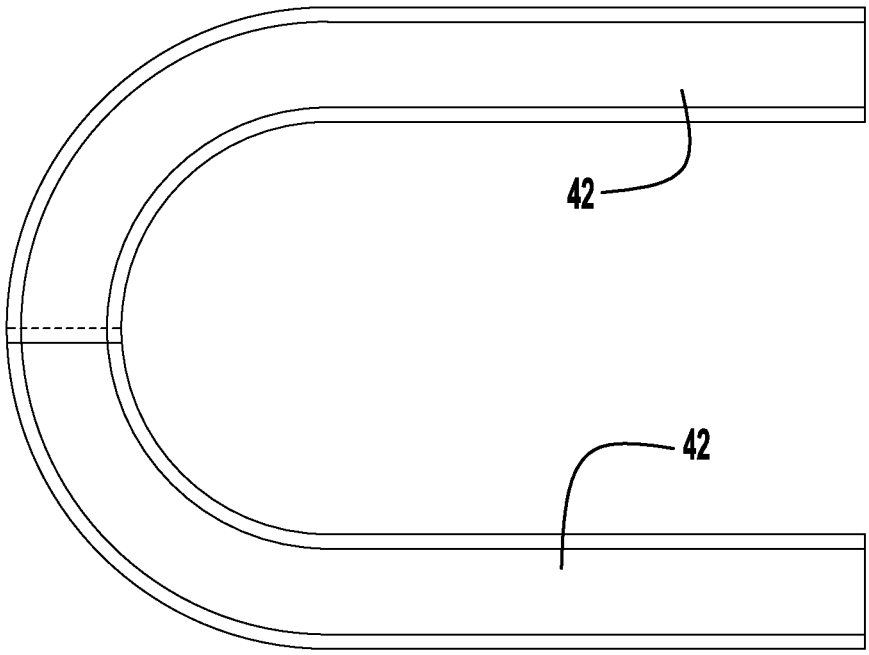
Figure 4:
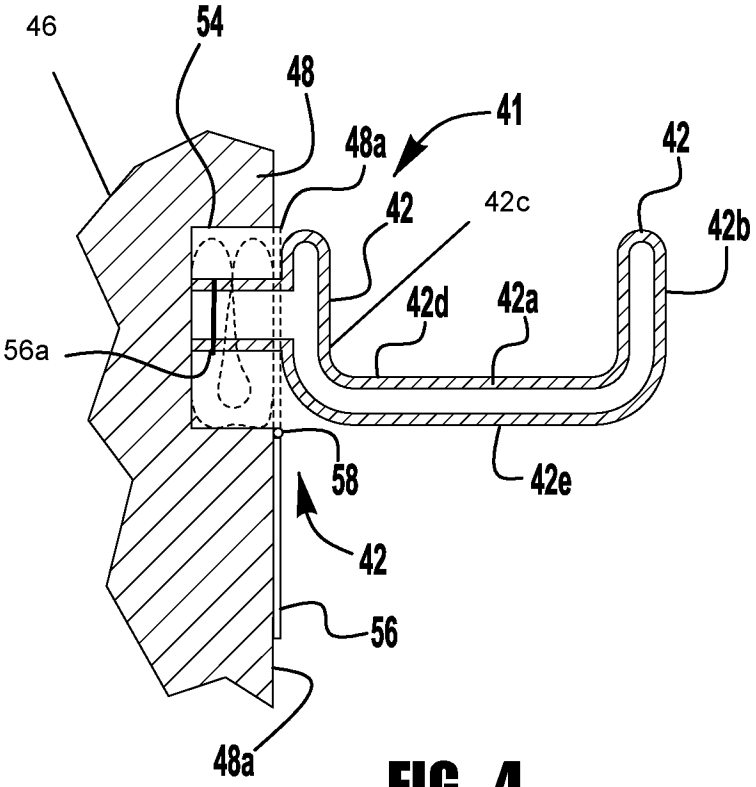

FIG. 4 is a cross-sectional view through line 4-4 of FIG. 2, showing the second embodiment of the emergency slide system in an open configuration, in accordance with the present invention.

FIG. 4A is a top view showing the emergency slide system off FIG. 4 in an open configuration, in accordance with the present invention.

Figure 5:
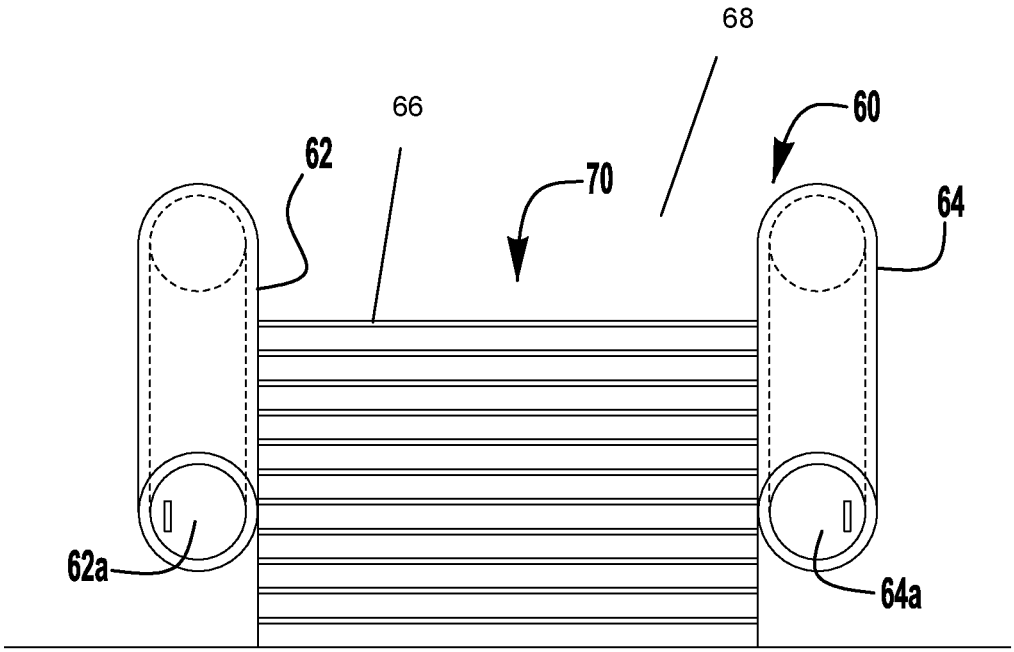

FIG. 5 is a top view of a third embodiment of the emergency slide system in a stairwell, in accordance with the present invention.

Figure 6:
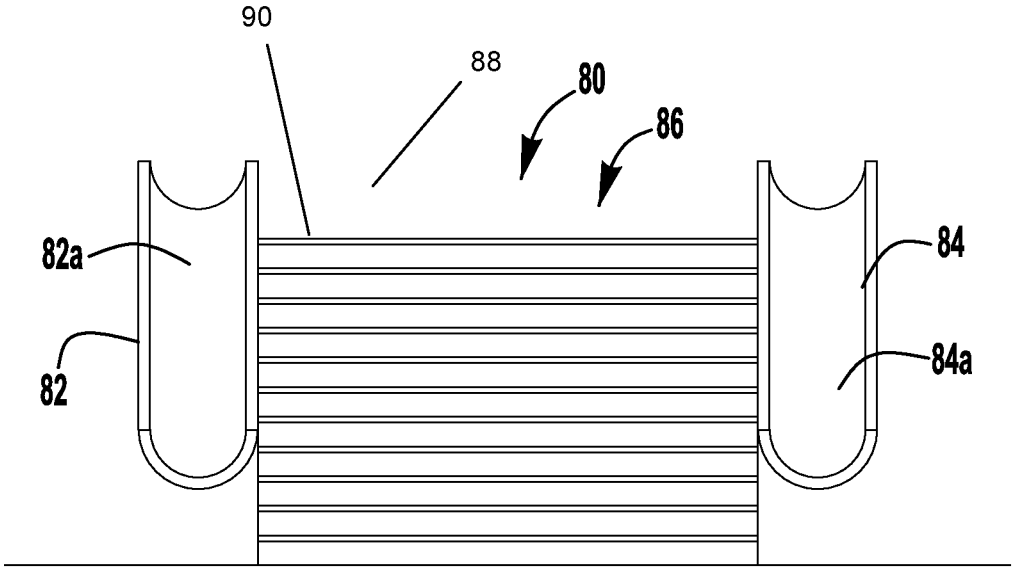

FIG. 6 is a top view of a fourth embodiment of the emergency slide system in a stairwell, in accordance with the present invention.

DETAILED DESCRIPTION OF THE PREFERRED EMBODIMENTS

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

The emergency slide system 10, as illustrated in FIGS. 1 and 2, is designed as a novel, unique escape system which advances the state of the art in building escape mechanisms. Traditional escape system had severe problems in dealing with three major characteristics of any emergency escape situations from the high-rise building.

The first major characteristic is that in an emergency event requiring evacuation from a high-rise building, whether from fire, earthquake, or sudden structural failure, usually results in interruption to most normal utilities, including electricity and lights. Elevators have been excluded as an escape apparatus both because of their known propensity to be damaged by the loss of the utilities and because their control can fail catastrophically during a fire. In fact, they are so dangerous that they are posted with signs according to standard safety regulations prohibiting their use during an emergency event requiring evacuation from a high-rise building, as discussed hereinbefore.

The second major characteristic of any emergency situation requiring evacuation from a high-rise building is that the people who must be evacuated cannot be assumed to be in any particular physical condition or have any specified qualifications. Any practical escape apparatus must allow for people of limited strength, the handicapped, or relatively immobile. Specific problems are created by persons in wheelchairs, the blind, or persons who have limited walking or running abilities.

The third major characteristic of any emergency situation requiring evacuation from a high-rise building is that the evacuation emergency will induce panic. This results from the typical evacuee being a person who is incapable of any complicated task, especially those tasks which involve controlling or operating a complex escape apparatus.

Evacuations normally involve one of three techniques. The first and oldest technique is a manual descent from the building by use of various forms of escape ladders or stairs. It should be obvious that in a high-rise building, defined as one having more than approximately eight to ten stories, a significant number of the people present will lack the strength to descend such a ladder, and panic will result in piling up of people, falls and serious injuries on so long a descent. Fire escape stairs, integrally built into a high-rise building, are additionally notorious as traps. In any case, persons who are handicapped simply cannot use such an escape means.

The second technique is removal by external escape devices. Ground based devices are all functionally "cherry-picker" like assemblies which can be raised from the ground, but which are practically limited to about the first four to five floors of any high-rise building. This renders ground-based devices useless in the case of the need to escape from a high-rise building.

Helicopter escape, while honored in television and in literature, is impractical except for removing people from the flat roof of a building. The turbulence encountered in a fire situation renders operation of a helicopter in close proximity of a burning building extremely risky and has been known to limit successful escapes using such means. Further, the requirement that the persons must be removed from a flat ledge or surface reintroduces the escape problem by requiring the persons to go up instead of down.

The emergency slide system 10, as shown in FIGS. 1 and 2, is designed to alleviate the previously mentioned issues, and provide a safe and effective manner of building evacuation during an emergency.

FIGS. 1 and 2 illustrate a first embodiment of the emergency slide system 10. In general terms, the emergency slide system 10 adapted and configured for movement from a stowed position shown in FIG. 1 to a deployed position shown in FIG. 2. The slide system 10 is designed to facilitate the efficient emergency evacuation of a building while permitting access to the building via the staircase by firefighters and other emergency personnel.

The emergency slide system 10 is constructed of a plurality of slide assemblies 12 located in a stairwell 14 within a high-rise building 16. The emergency slide system 10 is built into a wall 18 adjacent each of the flights of stairs 20 disposed in a staircase 21. The emergency slide system 10 comprises a plurality of slide assemblies 12 (two of which being illustrated) and each housed in a storage enclosure 24 built-in to the wall 18 adjacent each flight of stairs 20. The storage enclosures 24 are disposed generally parallel to the flights of stairs designed to zig zag down from the top floor of the building to the bottom floor.

The slide assembly 22 is constructed of an elongated escape chute 26 which has a concave, smooth inner surface 26*a* adapted to enable a person exiting the building to slide down the plurality of escape chutes 26 between floors 28 (28*a*, 28*b*, 28*c*) of the stairwell high-rise building 16. Preferably, the width of the escape chute 26 is sufficient to enable a person to utilize the device, while allowing for and not inhibiting adequate access to the staircase. The slide system 10 is preferably stowed in a manner that does not interfere with the normal use of the stairwell 21, such as within a cavity or storage enclosure 24 formed into the sidewall of the staircase 21.

As illustrated in FIG. 1, the slide assembly 22 is pivotally mounted in an angular condition within a storage enclosure 24 within the wall 18 above the flight of stairs 20. The slide assembly 22 can go from a first stored position within the storage enclosure 24 mounted in the wall 18 to a second, extended position over the stairs 20. This allows people a safe and rapid exit from the high-rise building 16 during an emergency when an elevator in the high-rise building is not to be used.

In the first stored position, the escape chute 26 is pivoted about a hinge 30 or similar connective devices, as shown in FIG. 2, connecting the escape chute 26 to a support plate 32 which can be secured to an inner surface 24*a* of the storage enclosure 24. In the first storage position with the escape chute 26 in place within the storage enclosure 24. A cover plate 34 which is secured at one end to the escape chute 26 is pivoted about the hinge 30 or similar connective devices is pivoted in an upward arc until it rests against the upper edge 18*b* of the wall 18 so that the storage enclosure 24 is closed. It is within the terms of the present invention for the cover plate 34 to be secured to the escape chute 22 so that when the escape chute 22 is moved from first stored position within the storage enclosure 24 to the second, extended position as shown in FIG. 2, the cover plate 34 pivots downward to rest against the wall 18, as shown in FIG. 2. In this way, the cover plate 34 provides a support for the escape chute 12 so that it remains in place, essentially perpendicular to the wall 18, irrespective of the weight of the person using the escape chute 22.

As shown in FIG. 2A, the slide assemblies 22 can be interconnected so that the elongated escape chutes 26 are connected to each other end to end to provide an elongated concave, smooth inner surface 26*a* which zig zags between the floors 28 of the stairwell in the high-rise building to enable a person exiting the building to slide down the plurality of escape chutes 26 between floors 28 of the stairwell high-rise building 16. As shown in FIG. 2A, the ends 27 of the escape chutes are curved and are adapted to overlap so that they can be connected end to end and form a single chute that extends from the upper floor to the bottom floor of the building.

In use, a person exits a floor through an exit doorway 36 and steps onto the stair 28*a* of the flight of stairs 20. Then, the person opens the storage enclosure 24 by pulling the cover plate 34 away from the upper edge 18*b* of the wall 18 so that the cover plate pivots downward and engages the wall 18, as shown in FIG. 2. Then the person can slide down the concave, smooth inner surface 26*a* of the elongated escape chute 26 until reaching the floor 28*b*. Next, the person can get out of the escape chute 26 and pull open the next cover plate so that the next elongated escape chute 26 opens as described herein before. When the person reaches the lower end of the escape chute 26, the person can open the cover plate of the lower and adjacent storage enclosure 24 so that by the time the person reaches the bottom of the high rise building, all of the chutes will be open so that the escape chutes 26 are connected to provide a wrap-around slide. Alternatively, the ends of the chutes don't have to engage each of the and the user has to get up and move onto the next adjacent chute to continue moving down through the stairwell.

FIGS. 3 and 4 illustrate a second embodiment of the emergency slide system 40. In general terms, the emergency slide system 40 adapted and configured for movement from a stowed position shown in FIG. 3 to a deployed position shown in FIG. 4. The slide system 40 is designed to facilitate the efficient emergency evacuation of a high-rise building while permitting access to the building via the staircase by firefighters and other emergency personnel.

The emergency slide system 40 is constructed of a plurality of slide assemblies 42 located in a stairwell 44 within a high-rise building 46. The emergency slide system 40 is built into a wall 48 adjacent each of the flights of stairs 50. The emergency slide system 40 comprises a plurality of slide assemblies 42 (two of which being illustrated) and each housed in a storage enclosure 54 built in the wall 48 adjacent each flight of stairs 50. The storage enclosures 54 are disposed generally parallel to the flights of stairs which are designed to zig zag down from the top floor of the high-rise building to the bottom floor.

The slide assembly 41 is constructed of an elongated escape chute 42 which has a smooth inner surface 42*a* adapted to enable a person exiting the building to slide down the plurality of escape chutes 42 between floors 47 (47*a*, 47*b*, 47*c*) of the high-rise building 46. Preferably, the width of the escape chute 42 is sufficient to enable a person to utilize the device, while allowing for and not inhibiting adequate access to the staircase 44. The slide system 41 is preferably stowed in a manner that does not interfere with the normal use of the staircase, such as within a cavity or storage enclosure 54 formed into the sidewall 48 of the staircase.

As illustrated in FIG. 3, the slide assembly 41 has an accordion shape with two side walls 42*b* and 42*c* and a bottom wall 42*a* therebetween. The slide assembly 41 can be constructed of an elongated chute 42 with upper and lower surfaces 42*d* and 42*e* connected to the storage enclosure 54 by a cylindrical section 56. The outer end 56*a* of the cylindrical section 56 is connected to the upper and lower surfaces 42*d* and 42*e*. The elongated chute 42 can be constructed of a flexible material, such as elastomeric material, polyurethane, nylon, PTFE having the ability to bend or compress without cracking under normal conditions. The material for the slide assembly 41 can be stiff enough to maintain its shape as shown in FIG. 4. At the same time, the material can be flexible enough to press the slide assembly 41 by the side wall 42*b* into the enclosure 54.

As shown in FIG. 4A, the slide assemblies 41 can be interconnected so that the elongated escape chutes 42 are connected to each other end to end to provide an elongated concave, smooth inner surface 42*a* which zig zags between the floors 47 of the stairwell in the high-rise building to enable a person exiting the building to slide down the plurality of escape chutes 42 between floors of the stairwell high-rise building 16. As shown in FIG. 4A, the ends 47 of the escape chutes 42 are curved and are adapted to overlap so that they can be connected end to end and form a single chute that extends from the upper floor to the bottom floor of the building.

A cover plate 56 which is pivoted about a hinge 58 or similar connective devices, as shown in FIG. 4, has a first position where it is pivoted upward against the upper edge 48*a* of the wall 48 so that the storage enclosure 54 is closed. It is within the terms of the present invention for the cover plate 56 to be disposed in the second, extended position as shown in FIG. 4, where the cover plate 56 pivots downward to rest against the wall 48*a*, as shown in FIG. 4.

The slide assembly 42 can go from a first stored position within the storage enclosure 54 mounted in the wall 48 to a second, extended position where the chute 42 projects out from the storage enclosure 54 so as to extend over the stairs 50. This allows people a safe and rapid exit from the high-rise building 46 during an emergency when an elevator in the high-rise building is not to be used.

In the first stored position, the escape chute 42 is pressed into the storage enclosure 54. In the first storage position with the escape chute 42 in place within the storage enclosure 54, the cover plate 56 which is pivoted about a hinge 58 or similar connective devices, is pivoted upward against the upper edge 48*a* of the wall 48 so that the storage enclosure 54 is closed. When the escape chute 42 is moved from first stored position within the storage enclosure 54 to the second, extended position as shown in FIG. 4, the cover plate 56 pivots downward to rest against the wall 48.

FIG. 5 illustrates a third embodiment of the emergency slide system 60. In general terms, the emergency slide system 60 adapted and configured for the ability to escape from either side of the stairs 70. The slide system 60 is designed to facilitate the efficient emergency evacuation of a building while permitting access to the building via the staircase by firefighters and other emergency personnel.

The emergency slide system 60 is constructed of two cylindrical tubes 62 and 64 located in a stairwell 66 within a high-rise building 68. The emergency slide system 60 is built adjacent each of the flights of stairs 70. The tubes 62 and 64 are disposed generally adjacent to the flights of stairs designed to zig zag down from the top floor of the building to the bottom floor. It is also within he terms of the present invention for the tubes 62 and 64 to be of separate sections with one section adjacent each flight of stairs. Then, the person can get out from a section of tube and enter a separate lower placed section of tube.

Tubes 62 and 64 of the slide assembly 60 have a smooth inner surface 62*a* and 64*a* adapted to enable a person exiting the building to slide down the plurality of escape tubes 62 and 64 between floors of the high-rise building. Preferably, the width of the escape tubes 62 and 64 is sufficient to enable a person to utilize the device, while allowing for and not inhibiting adequate access to the staircase.

FIG. 6 illustrates a fourth embodiment of the emergency slide system 80. In general terms, the emergency slide system 80 is adapted and configured for the ability to escape from either side of the stairs 86. The slide system 80 is designed to facilitate the efficient emergency evacuation of a building while permitting access to the building via the staircase by firefighters and other emergency personnel.

The emergency slide system 80 is constructed of two cylindrical half tubes 82 and 84 located in a stairwell 86 within a high-rise building 88. The emergency slide system 80 is built adjacent each of the flights of stairs 90. The tubes 82 and 84 are disposed generally adjacent to the flights of stairs designed to zig zag down from the top floor of the building to the bottom floor.

Tubes 82 and 84 of the slide assembly 80 have a smooth inner surface 82*a* and 84*a* adapted to enable a person exiting the building to slide down the plurality of escape tubes 82 and 84 between floors of the high-rise building. Preferably, the width of the escape tubes 82 and 84 is sufficient enough to enable a person to utilize the device, while allowing for and not inhibiting adequate access to the staircase.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An emergency slide system to provide an evacuation of a high-rise building, comprising:

a plurality of slide assemblies configured for movement from a first stowed position to a second deployed position;

each of the plurality of slide assemblies being built into a wall adjacent each of the flights of stairs disposed in the stairwell of the high-rise building, each of the plurality of slide assemblies being disposed in a first stowed position within one of a plurality of a storage enclosures above the flight of stairs and pivotally mounted to move to a second extended position over the stairs;

each of the plurality of slide assemblies being disposed in one of the plurality of storage enclosures built into the wall adjacent each of the flights of stairs disposed generally parallel to the flights of stairs designed to zig zag down from an upper floor of the building to a lower floor;

each of the plurality of slide assemblies being constructed of an elongated escape chute to enable a person exiting the building to slide down a plurality of the elongated escape chutes between the upper and lower floors disposed in the stairwell of the high-rise building;

each of the elongated escape chutes connected to a support plate secured to an inner surface of one of the plurality of the storage enclosures; and a plurality of cover plates each pivotally secured at one end to one of the escape chutes whereby when the cover plate rests against a wall of the storage enclosure the storage enclosure is closed and when one of the escape chutes is moved from the first stowed position within the storage enclosure to the second deployed position over the stairs, the cover plate pivots downward to rest against the wall and provides a support for the escape chutes so that they remain in place irrespective of the weight of the person using the escape chutes.

2. The emergency slide system of claim 1 wherein each of the plurality of slide assemblies is housed in a one of the plurality of storage enclosures built-in to the wall adjacent each flight of stairs disposed in the stairwell of the high-rise building.

3. The emergency slide system of claim 2 wherein each of the elongated escape chutes has a concave, smooth inner surface to enable a person exiting the building to slide down the plurality of escape chutes disposed in the stairwell of the high-rise building.

4. The emergency slide system of claim 3 wherein each of the plurality of storage enclosures is disposed generally aligned with and parallel to the adjacent flight of stairs.

5. The emergency slide system of claim 4 wherein each of the plurality of storage enclosures are built-in to the wall adjacent each flight of stairs in a zig zag configuration extending from an upper floor of the building to a lower floor of the building.

6. The emergency slide system of claim 5 wherein each of the elongated escape chutes is sufficiently wide to enable a person to utilize the device, while allowing for and not inhibiting adequate access to the stairs.

7. The emergency slide system of claim 4 wherein each of the plurality of slide assemblies is pivotally mounted in an angular condition within one of the plurality of storage enclosures within the wall above the flight of stairs whereby each of the plurality of slide assemblies can go from a first stored position within one of the plurality of storage enclosures mounted in the wall to a second, extended position over the stairs.

8. The emergency slide system of claim 7 wherein the slide assemblies can be disposed so that the elongated escape chutes are connected to each other end to end to provide an elongated concave, smooth inner surface which zig zags between the floors of the stairwell in the high-rise building to enable a person to slide down the plurality of escape chutes between floors of the stairwell high-rise building.

* * * * *